US011452356B2

(12) United States Patent
Prade et al.

(10) Patent No.: US 11,452,356 B2
(45) **Date of Patent: *Sep. 27, 2022**

(54) COSMETIC APPLICATOR

(71) Applicant: L'OREAL, Paris (FR)

(72) Inventors: Pauline Prade, Clichy (FR); Chloé Cabon, Clichy (FR); Alain Berhault, Le re Saint Gervais (FR); Eric Caulier, Ferriéres (FR)

(73) Assignee: L'OREAL, Paris (FR)

( * ) Notice: Subject to any disclaimer, the term of this patent is extended or adjusted under 35 U.S.C. 154(b) by 192 days.

This patent is subject to a terminal disclaimer.

(21) Appl. No.: 16/711,615

(22) Filed: Dec. 12, 2019

(65) Prior Publication Data

US 2020/0163437 A1 May 28, 2020

Related U.S. Application Data

(63) Continuation of application No. 15/575,100, filed as application No. PCT/EP2016/060416 on May 10, 2016, now Pat. No. 10,835,015.

(30) Foreign Application Priority Data

May 20, 2015 (FR) ..... 1554513

(51) Int. Cl.

| | |
|---|---|
| ***A45D 34/04*** | (2006.01) |
| ***A45D 40/20*** | (2006.01) |
| ***A45D 40/26*** | (2006.01) |

(52) U.S. Cl.

CPC ..... *A45D 34/042* (2013.01); *A45D 40/20* (2013.01); *A45D 40/262* (2013.01); *A45D 2200/1072* (2013.01)

(58) Field of Classification Search

CPC .. A45D 34/043; A45D 34/045; A45D 34/042; A45D 40/264; A45D 40/265; A45D 40/28; A45D 40/262; A45D 2200/1072

(Continued)

(56) References Cited

U.S. PATENT DOCUMENTS

| | | | | |
|---|---|---|---|---|
| 10,021,953 | B2 * | 7/2018 | Kudo | A45D 34/042 |
| 2007/0181143 | A1 * | 8/2007 | Montoli | A45D 34/04 132/320 |

(Continued)

FOREIGN PATENT DOCUMENTS

| | | | |
|---|---|---|---|
| DE | 19912004 | A1 | 9/2000 |
| EP | 1961580 | A2 | 8/2008 |

(Continued)

OTHER PUBLICATIONS

Sephora, "Dramatic Line—Eyeliner 24 hr Felt Liner XXL", https://www.sephora.fr/p/dramatic-line--eyeliner-feutre-24hr-P1908006.html#product-info, access on Jun. 4, 2020.

(Continued)

*Primary Examiner* — Nicholas D Lucchesi

(74) *Attorney, Agent, or Firm* — McNees Wallace & Nurick LLC

(57) ABSTRACT

Applicator for applying a cosmetic product to human keratin materials, having:

Figure 1:
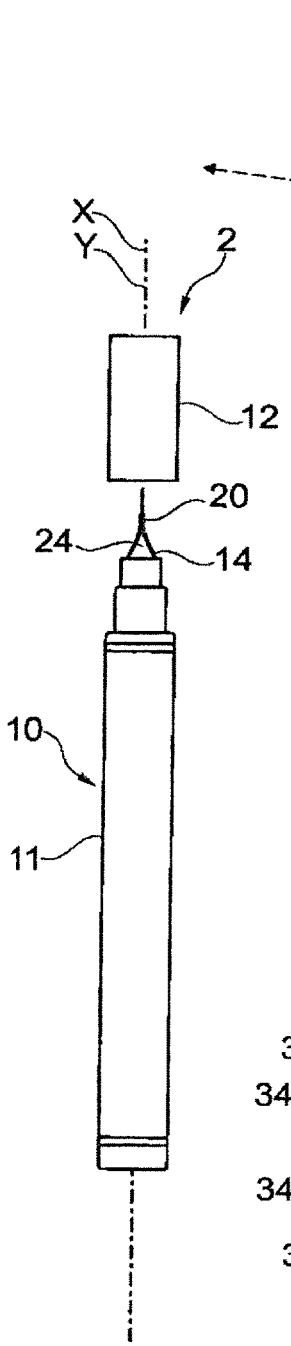

a holder and an applicator tip (20), of longitudinal axis (X), that is carried by the holder and has:

a base part (22), of axis (X), for fastening to the holder by way of at least one of its portions, and an application part (24) that is attached to the base part (22) and has at least three surfaces (26, 28, 30), each having a contour formed by at least one edge (34), and/or (Continued)

a base line (36) that acts as a junction between the application part (24) and a cylindrical portion, of axis (X), of the base part (22), the shapes of the contours of the surfaces (26, 28, 30) being different in pairs and not symmetrical to one another about an axis or a median plane.

14 Claims, 4 Drawing Sheets

(58) Field of Classification Search
USPC ..... 132/320, 317, 218
See application file for complete search history.

(56) References Cited

U.S. PATENT DOCUMENTS

| | | | | |
|---|---|---|---|---|
| 2009/0269121 | A1* | 10/2009 | Snedden | B43M 11/06 401/183 |
| 2017/0238673 | A1* | 8/2017 | Caulier | A45D 40/261 |
| 2017/0251786 | A1* | 9/2017 | Kudo | B65D 41/02 |
| 2018/0325237 | A1* | 11/2018 | Caulier | A45D 40/26 |

FOREIGN PATENT DOCUMENTS

| | | | | |
|---|---|---|---|---|
| FR | 2836031 | A1 | 8/2003 | |
| FR | 2933281 | A1 | 1/2010 | |
| FR | 3012946 | A1 | 5/2015 | |
| JP | H0516377 | U | 3/1993 | |
| JP | 2008012177 | A | 1/2008 | |
| WO | WO-2015071818 | A1 * | 5/2015 | A45D 40/20 |

OTHER PUBLICATIONS

Yasuhiko Murayama; Final Office Action; Japanese Application No. 2017-560-560209; drafted Oct. 18, 2019.

English translation of Japanese Final Office Action dated Oct. 18, 2019; Japanese Patent Application 2017-560209.

PCT International Search Report and Written Opinion of the International Searching Authority, 8 pages, Jul. 2016.

* cited by examiner

COSMETIC APPLICATOR

The present invention relates to applicators for applying a cosmetic product to human keratin materials and more particularly, but not exclusively, to applicators for applying eyeliner, a product to the lips, eyeshadow or mascara. The invention also relates to a corresponding packaging and application device and a corresponding makeup method.

Among known devices for applying eyeliner, some have a container provided with a threaded neck on which there can be fixed a closure cap which carries a stem provided at its end with an applicator end piece that is generally produced by injection-moulding thermoplastic material with a flocked coating. A wiping member is usually positioned in the neck in order to wipe off the stem and reduce the quantity of product taken when the applicator is withdrawn.

Applicator pens, which are more practical to use, are also known. However, the performance of these pens is sometimes inferior to that which it is possible to obtain with complex shapes of known applicator end pieces that are produced by injection-moulding or by machining a felt tip.

FR 2 933 281 describes an eyeliner applicator having a stem and an applicator end piece that is carried by the stem, is able to deform during use and makes it possible, depending on the orientation selected, to draw two lines with different thicknesses.

FR 2 836 031 discloses an eyeliner applicator having at least two tips.

There is a need for other applicators for drawing different lines depending on the orientation given to the applicator, said applicators being relatively easy to use and to manufacture.

Therefore, the invention aims to further improve applicators for applying a cosmetic product to keratin materials and it achieves this by virtue of an applicator for applying a cosmetic product to human keratin materials, having:

- a holder and
- an applicator tip, of longitudinal axis (X), that is carried by the holder and has:
  - a base part, of axis (X), for fastening to the holder by way of at least one of its portions, and
  - an application part that is attached to the base part and has at least three surfaces, each having a contour formed by
    - at least one edge, and/or
    - a base line that acts as a junction between the application part and a cylindrical portion, of axis (X), of the base part, the shapes of the contours of said surfaces being different in pairs and not symmetrical to one another about an axis or a median plane.

The invention allows new makeup effects depending on the shapes and contours given to the application surfaces and makes it easier to apply the product, notably by improving the ease of use and effectiveness of the applicator.

Preferably, the applicator tip is in one piece.

The applicator tip is advantageously made of a porous material, notably of synthetic or natural fibres that are all oriented substantially in the same direction, notably along the longitudinal axis (X), and assembled to form a felt. The applicator tip is preferably impregnated with the cosmetic product to be applied, notably eyeliner, a lip product, eyeshadow or mascara. This can allow the product to diffuse easily by capillary action within the applicator end piece on account of its porosity. The fibres make it possible to transport the product along the applicator tip.

The applicator tip can be dipped in a reservoir of cosmetic product outside periods of use, this allowing notably greater autonomy thereof.

The base part can extend from one end of the applicator tip to the application part and the application part can extend from the base part to the other end of the applicator tip. Thus, the applicator tip is constituted, between its two ends, of the base part and the application part only.

The applicator tip is preferably produced by cutting a one-piece cylindrical part, notably by cutting said surfaces into the cylindrical part, notably with the aid of a cutting tool that is movable and orientable in all spatial directions. The cylindrical part has a base that is circular or non-circular, for example elliptical or polygonal, notably square, rectangular or triangular. Preferably, the cylindrical part has a circular base. When the cylindrical part has a non-circular base, its diameter is by extension that of the smallest circle in which the section is inscribed.

It is possible for the cylindrical part not to have steps, or to have two cylindrical portions with different diameters, notably one of the cylindrical portions, preferably the portion with a greater diameter, being intended to form the application part and the other of the cylindrical portions being intended to form the base part.

The base part may be inserted at least partially, for example entirely, in the holder. The base part may be force-fitted in a housing of the holder.

The cylindrical portion of the base part, notably the entire base part, may be in the form of a cylinder of revolution or be cylindrical with a non-circular base, notably a rectangular or triangular base.

The application part may have a height $H_2$ less than or equal to 50%, better still less than or equal to 25% of the overall height $H_1$ of the applicator tip.

The height $H_2$ of the application part may be between 0.5 and 20 mm.

It is possible for the applicator tip not to have an axis of symmetry.

The applicator tip may have at least one plane of symmetry, preferably a single plane of symmetry, notably a plane of symmetry containing the longitudinal axis of the applicator tip.

The ratio $d/H_2$, of the greatest dimension d in cross section of the applicator tip and the height $H_2$ of the application part, may be between 0.04 and 14.

The largest dimension d in cross section of the applicator tip may be between 0.8 mm and 7 mm.

When the largest dimension d in cross section of the applicator tip and the height $H_2$ of the application part are small, the applicator tip is relatively rigid and can allow precise application of the product.

When the largest dimension din cross section of the applicator tip is small and the height $H_2$ of the application part is large, the applicator tip is flexible, while retaining precision of application of the product.

When the largest dimension d in cross section of the applicator tip is large and the height $H_2$ of the application part is small, the applicator tip is rigid and allows stable application of the dabbing type to the skin.

When the largest dimension d in cross section of the applicator tip and the height $H_2$ of the application part are large, this makes it possible to have stable application of product for a marked makeup effect.

The surfaces can each be planar or non-planar, notably concave, convex or axisymmetrical. The edges may or may not be sharp.

Preferably, none of said surfaces is planar and perpendicular to the longitudinal axis.

The surfaces are preferably not in the form of cylinders of revolution.

A convex surface may allow a junction with the base part with or without an edge, that is to say with or without a break in gradient. The junction is then distinguished in that, on moving along the axis (X) from the base part to the application part, the tangent to the outer surface forms an angle with the longitudinal axis (X) that varies continuously.

Preferably, at least three of the surfaces are produced by cutting a cylindrical part. After the at least three surfaces have been cut, the applicator tip may or may not have one or more surfaces that have not been produced by cutting.

Preferably, at least three of said surfaces do not form, at the end of the application tip, a planar surface perpendicular to the longitudinal axis (X).

Each of the surfaces can have an area of between 1 $mm^2$ and 80 $mm^2$.

At least one of the surfaces can be planar and form an angle $\alpha$ of between 1° and 80° with respect to the longitudinal axis (X) of the applicator.

A small angle $\alpha$ with respect to the longitudinal axis (X) makes it possible to have an end of the applicator tip that is fine and to apply makeup precisely.

A large angle $\alpha$ with respect to the longitudinal axis (X) makes it possible to apply makeup by dabbing the applicator tip on the skin.

At least one of the surfaces can be concave or convex and have a radius of curvature of between 1 mm and 190 mm.

A surface having a small radius of curvature makes it possible for example to create a depression facilitating application with the aid of another of the surfaces.

A surface having a large radius of curvature makes it possible for example to apply makeup along the entire line above the eye in a single movement.

At least one of the surfaces can taper towards the distal end of the applicator tip.

At least two of the surfaces can have a common edge. The common edge can be rectilinear or non-rectilinear, notably concave or convex. Such an edge can make it possible to produce a fine line or a particular line profile depending on the curvature.

At least three of the surfaces can have a common apex. This makes it possible to have a fine tip for producing fine lines.

The applicator may have at least one additional contour surface that is formed by at least one edge and/or by a base line that acts as a junction between the application part and a cylindrical portion, of axis (X), of the base part, and has a contour either with a shape identical to that of one of said surfaces or symmetrical to that of one of said surfaces with respect to an axis or to a plane.

A further subject of the invention is a packaging and application device, having:

- a reservoir containing the cosmetic product, notably a makeup product, in particular an eyeliner, a product to be applied to the lips, an eyeshadow or a mascara,
- an applicator according to the invention.

The cosmetic product can have one or more coloured pigments.

The holder of the applicator can form the reservoir containing the cosmetic product. The device can then be in the form of a felt containing the cosmetic product, the applicator tip being dipped in the cosmetic product, by its base part inserted into the holder, such that the cosmetic product is conveyed to the application part by capillary action.

In a variant, the reservoir is separate from the applicator. The holder can be a stem mounted on a cap of a container containing the product to be applied such that the applicator tip can be inserted into the container in order to be impregnated with cosmetic product.

A further subject of the invention is a method for making up the eyelid, having the step of applying eyeliner, a lip product, a mascara or an eyeshadow with the aid of an applicator according to the invention or of a device according to the invention.

A further subject of the invention is a method for making up the lips, having the step of applying lipstick with the aid of an applicator according to the invention or of a device according to the invention.

A further subject of the invention is a method for making up the eyebrows, having the step of applying mascara with the aid of an applicator according to the invention or of a device according to the invention.

Figure 4:
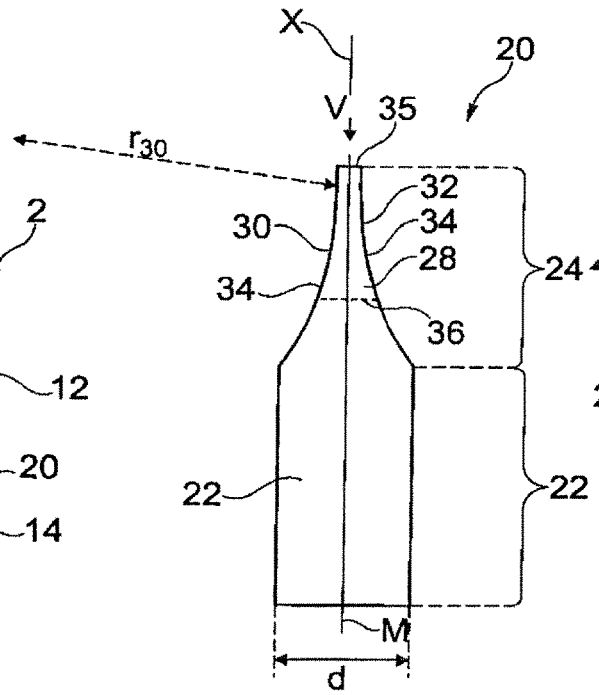
Figure 3:
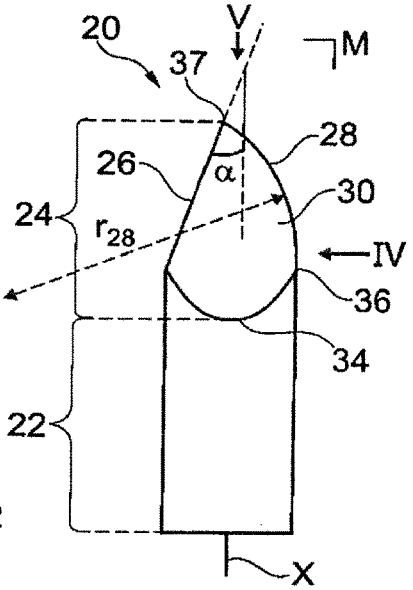
Figure 5:
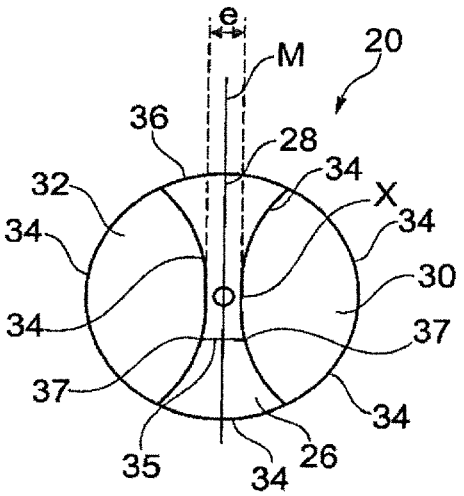
Figure 2:
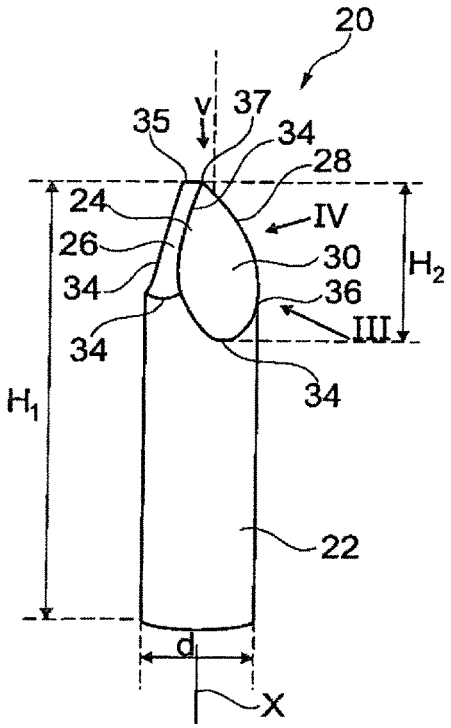
Figure 7:
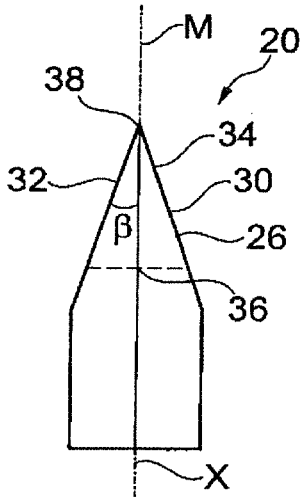
Figure 6:
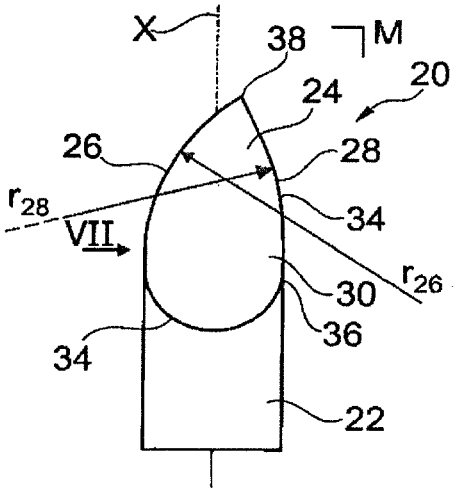
Figure 10:
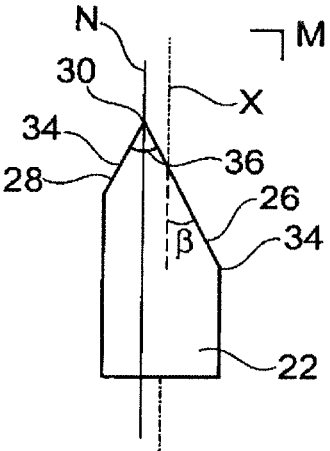
Figure 9:
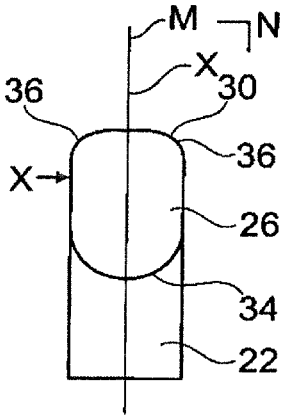
Figure 8:
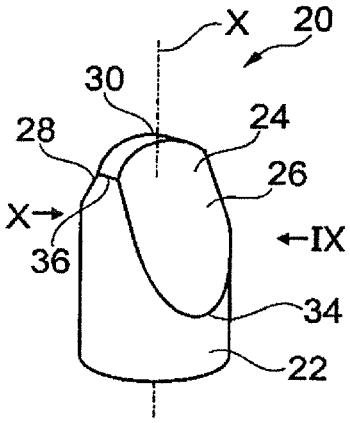
Figure 13:
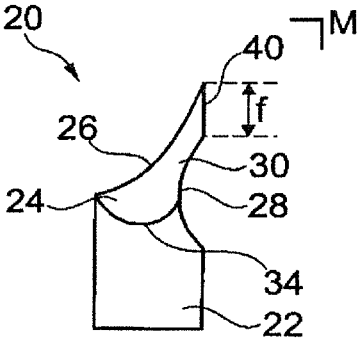
Figure 12:
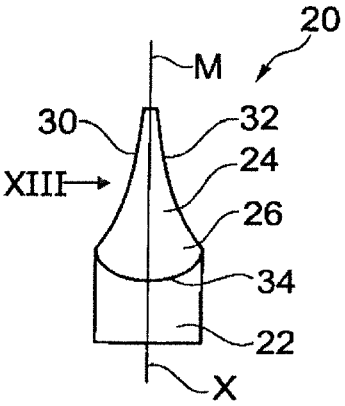
Figure 11:
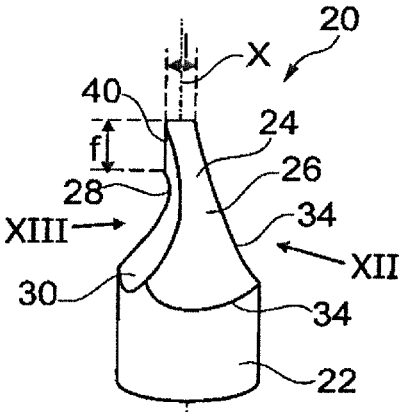
Figure 14:
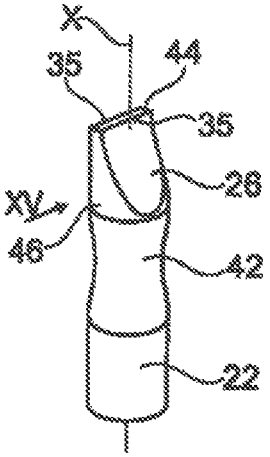
Figure 15:
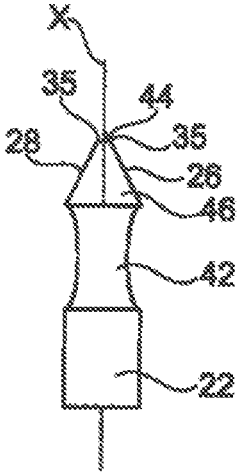
Figure 16:
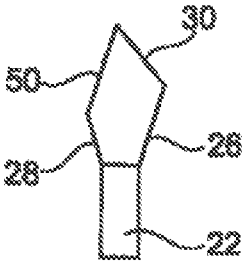
Figure 17:
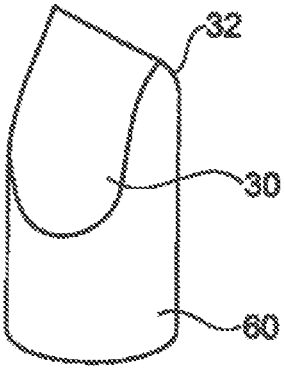
Figure 18:
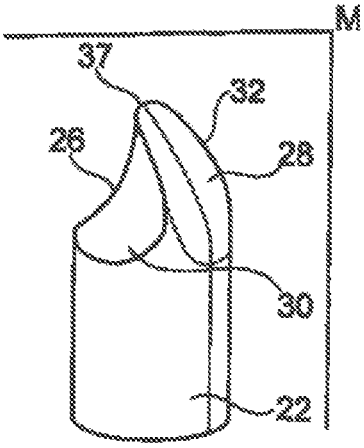
Figure 19:
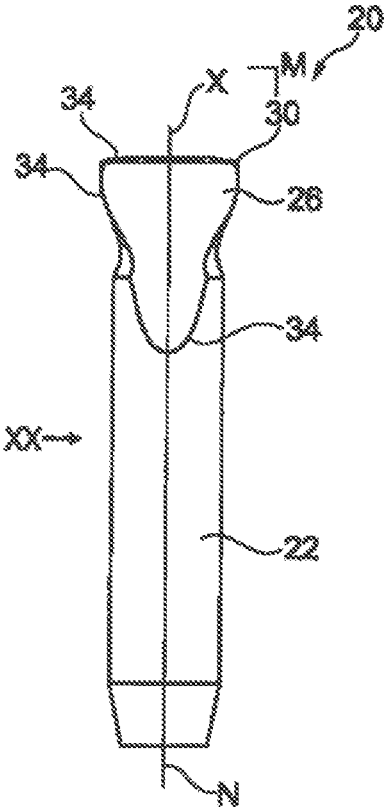
Figure 20:
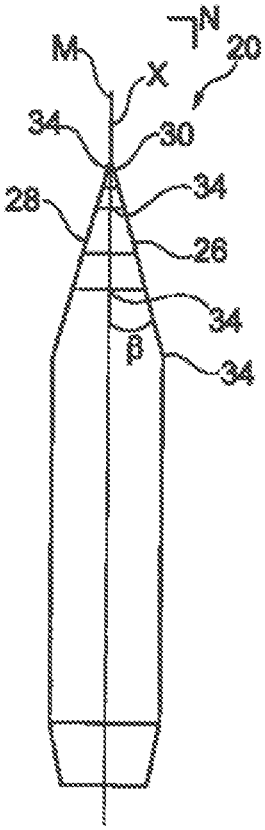
Figure 21:
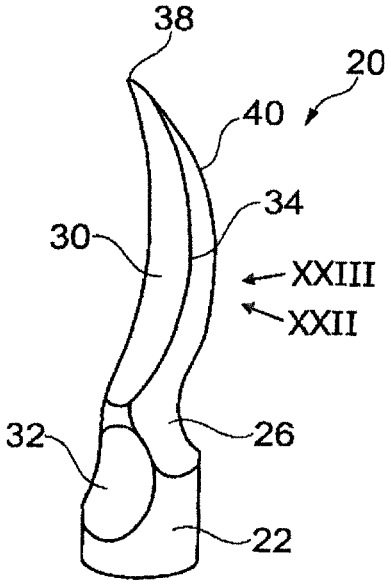
Figure 22:
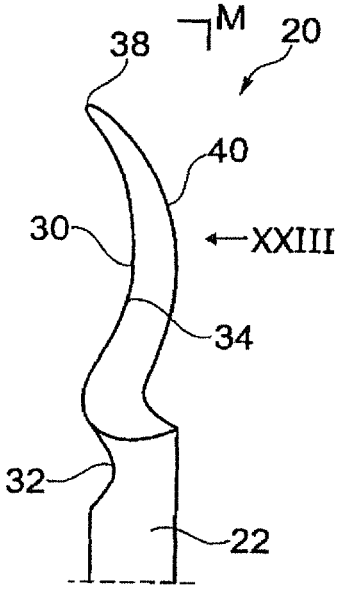
Figure 23:
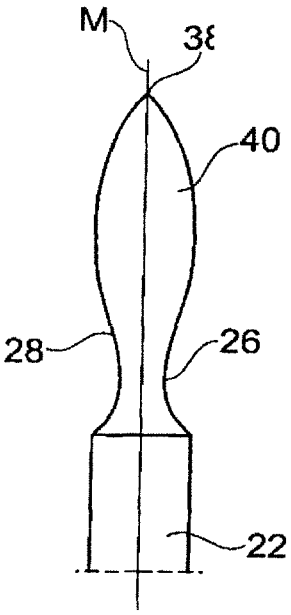

Further features and advantages of the present invention will become apparent from reading the following detailed description of nonlimiting illustrative embodiments thereof and from examining the appended drawing, in which:

FIG. 1 schematically shows an example of a packaging and application device according to the invention, FIG. 2 schematically shows a perspective view of an example of an applicator tip according to the invention, FIG. 3 is a view along III of the example of an applicator tip in FIG. 2, FIG. 4 is a view along IV of the example of an applicator tip in FIGS. 2 and 3, FIG. 5 is a view along V of the example of an applicator tip in FIGS. 2, 3 and 4, FIG. 6 schematically shows a side view of a variant applicator tip according to the invention, FIG. 7 is a view along VII of the variant applicator tip in FIG. 6, FIG. 8 shows a perspective schematic view of a variant applicator tip according to the invention, FIG. 9 is a view along IX of the variant applicator tip in FIG. 8, FIG. 10 is a view along X of the variant applicator tip in FIGS. 8 and 9, FIG. 11 shows a perspective schematic view of a variant applicator tip according to the invention, FIG. 12 is a view along XII of the variant applicator tip in FIG. 11, FIG. 13 is a view along XIII of the variant applicator tip in FIG. 12, FIG. 14 shows a perspective schematic view of a variant applicator tip according to the invention, FIG. 15 is a view along XV of the variant applicator tip in FIG. 14, FIG. 16 shows a schematic side view of a variant applicator tip according to the invention, FIGS. 17 and 18 schematically show two steps in the production of a variant applicator tip according to the invention, FIG. 19 shows a schematic view of a variant applicator tip according to the invention, FIG. 20 is a view along XX of the variant applicator tip in FIG. 19, FIG. 21 shows a perspective schematic view of a variant applicator tip according to the invention, FIG. 22 is a view along XXII of the variant applicator tip in FIG. 21, and FIG. 23 is a view along XXIII of the variant applicator tip in FIGS. 21 and 22.

Figure 25:
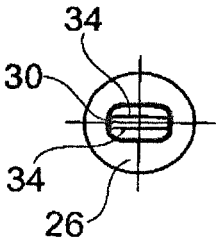
Figure 24:
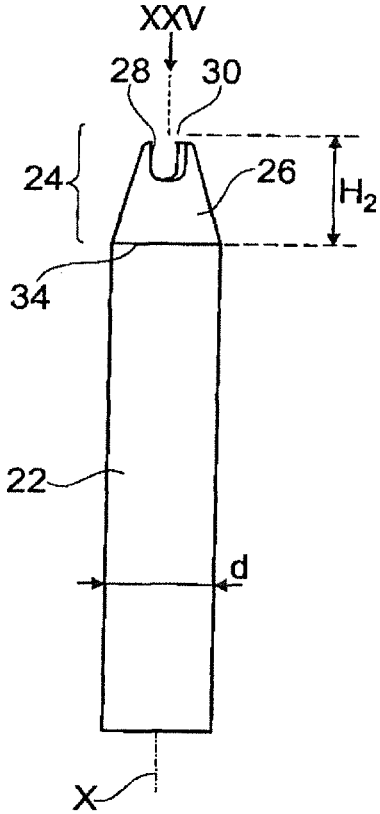

FIG. 24 shows an elevation view of another example of an applicator tip, and FIG. 25 is a view along XXV in FIG. 24.

In the rest of the description, identical or similar elements or elements having identical or similar functions bear the same reference signs in the figures, unless stated otherwise.

The packaging and application device 10 shown in FIG. 1 has a holder 11 and a closure cap 12 which is fixed on the holder 11 for example by snap-fastening, screwing or friction. The holder 11 extends along a longitudinal axis Y and defines a reservoir containing the cosmetic product.

The reservoir contains the cosmetic product to be applied. The latter may be a makeup product, notably an eyeliner, and comprise water, pigments, in particular iron oxide, colorants and/or polymers.

The capacity of the reservoir is for example between 1 and 10 ml.

The holder 11 bears, in a housing 14 at one of its ends, an applicator tip 20 that extends along a longitudinal axis X, shown in more detail in FIGS. 2 to 5.

Following insertion of the applicator tip 20, the longitudinal axis Y of the holder 11 and the longitudinal axis X of the applicator tip 20 are preferably coincident.

The applicator tip 20 is in one piece. It is preferably made entirely of felt, notably of synthetic or natural fibres that are all oriented substantially in the same direction, notably along the longitudinal axis X of the applicator tip 20, and assembled to form a felt. When it is inserted in the housing 14 of the holder 11, the applicator tip 20 can be dipped by one of its ends in the cosmetic product and be impregnated with the cosmetic product, notably eyeliner, by capillary action. This is the case in particular when the assembly of the holder 11 and the applicator tip 20 is such that the applicator tip 20 is oriented downwards.

As illustrated in FIGS. 2 to 4, the applicator tip 20 has a base part 22 for fastening the applicator tip 20 to the holder 11 and an application part 24 for applying the cosmetic product by coming into contact with the keratin materials, said application part 24 being attached to the base part 22.

The base part 22 is in the form of a cylinder of revolution about the longitudinal axis X, but other shapes are possible without departing from the scope of the present invention, notably a cylindrical shape with a non-circular section, notably a rectangular or triangular section.

The applicator tip 20 can be fixed to the holder 11 by any suitable means. For example, as illustrated in FIG. 1, the applicator tip 20, in particular the base part 22, can be forced-fitted into a corresponding housing 14 provided at the upper end of the holder 11. The base part 22 can be inserted at least partially into the housing 14.

The base part 22 is fed with product through its proximal end and the product can diffuse longitudinally through the applicator tip notably by capillary action until it reaches the application part 24.

The applicator tip 20 has a ratio $d/H_2$ of between 0.2 and 1.25, d being the largest dimension in cross section, in this case the diameter, of the applicator tip 20 and $H_2$ being the height of the application part 24.

d may be between 3 mm and 5 mm and $H_2$ may be between 4 mm and 15 mm.

As illustrated in FIG. 2, the application part 24 has a height $H_2$ less than or equal to 50% of the height $H_1$ of the applicator tip 20.

In the example illustrated in FIGS. 2 to 5, the application part 24 has four surfaces 26, 28, 30 and 32. The surfaces 26, 28 and 30 or 32 have different contours that are not symmetrical to one another. The surfaces 30 and 32 are symmetrical with respect to a median plane M.

The contour of each of the surfaces 26, 30 and 32 is formed by edges 34 with the other surfaces and with the base part 22. The contour of the surface 28 is formed by edges 34 with the other surfaces and by a curved base line 36 that acts as a junction with a portion of the base part 22. This curved base line 36 is defined by the line from which the tangent to the surface varies.

As illustrated in FIG. 3, the surface 26 is planar and forms, in view along the median plane M, an angle $\alpha$ of between 1° and 45°. The surface 26 forms, with the surfaces 30 and 32, curved edges 34 and forms, with the surface 28, a rectilinear edge 34, the latter being perpendicular to the longitudinal axis X.

The surface 28 is convex and has, when viewed in a direction perpendicular to the median plane M, a radius of curvature $r_{28}$ of between 3 mm and 20 mm. The surface 28 forms curved edges with the surfaces 30 and 32.

As illustrated in FIG. 4, the surfaces 30 and 32 are concave and have, when viewed in a direction in the median plane M, a radius of curvature $r_{30}$ of between 3 mm and 20 mm. The surfaces 30 and 32 each taper towards the end of the applicator tip 20 so as to end at a common apex with the surfaces 26, 28 and 30 and 26, 28 and 32, respectively.

The applicator tip 20 is produced by cutting the surfaces 26, 28, 30 and 32 in a one-piece cylindrical part, notably by cutting with the aid of a cutting tool (not shown) that is movable and orientable in all spatial directions.

The example in FIGS. 6 and 7 differs from the one in FIGS. 1 to 5 by way of the shape of the surfaces 26, 28, 30 and 32.

In the example in FIGS. 6 and 7, the surfaces 26 and 28 are convex and the surfaces 30 and 32 are planar. The surfaces 26 and 28 are attached to the base part 22 by a curved base line 36. The surface 26 has a radius of curvature $r_{26}$ of between 3 mm and 20 mm and the surface 28 has a radius of curvature $r_{28}$ of between 3 mm and 20 mm. The surfaces 30 and 32 form, when viewed in a direction perpendicular to the median plane M, an angle $\beta$ with the longitudinal axis X of between 5° and 30°.

The surfaces 26, 28, 30 and 32 have a common apex 38 at the distal end of the applicator tip 20.

The example in FIGS. 8 to 10 differs from the one in FIGS. 1 to 5 in that it has only three surfaces 26, 28 and 30 that are all different from one another.

The applicator tip 20 is symmetrical with respect to a median plane M.

The surfaces 26 and 28 are planar. The planes containing the surfaces 26 and 28 are symmetrical with respect to a plane N, shown in FIG. 10, which is parallel to the longitudinal axis X but does not contain the latter. The surfaces 26 and 28 have different, non-symmetrical contours and each form, when viewed in a direction perpendicular to the plane N, an angle $\beta$ with the longitudinal axis X of between 1° and 50°. The surfaces 26 and 28 do not have common edges. Their contour is formed by edges 34 with the surface 30 and with the base part 22.

The surface 30 is concave and constitutes the end of the applicator tip 20. It is symmetrical with respect to the median plane M and to the plane N. Its contour is formed by curved edges 34 with the surfaces 26 and 28 and by base lines 36 with the base part 22.

The example in FIGS. 11 to 13 differs from the one in FIGS. 1 to 5 in that the applicator tip 20 is in the form of a rearwardly curved tip.

The surfaces 26, 28, 30 and 32 are concave. The surfaces 26, 28 and 30 have different, non-symmetrical contours. The surfaces 30 and 32 have symmetrical contours to one another with respect to a median plane M. The contours are all delimited by edges 34.

The surface 28 does not extend as far as the distal end of the applicator tip 20. The applicator tip 20 has, at its end, a surface 40 that is not produced by cutting a cylindrical part but is a portion of the lateral surface of the initial cylindrical part. The surface 40 has a contour delimited by all of the other surfaces 26, 28, 30 and 32.

The example in FIGS. 14 and 15 differs from the one in FIGS. 1 to 5 in that the applicator tip 20 has two planar surfaces 26 and 28 that form different angles with the longitudinal axis X, and a surface of rotation 42. The surfaces 26, 28 and 42 have different, non-symmetrical contours.

The applicator tip 20 is symmetrical with respect to a median plane M.

Each of the surfaces 26 and 28 is attached to a planar end surface 44 perpendicular to the longitudinal axis X. The planar end surface 44 is not produced by cutting the initial cylindrical part; it corresponds to a portion of the base of said part.

The surfaces 26 and 28 are attached to identical surfaces 46 that correspond to lateral portions of the initial cylindrical part that have not been machined.

The surface 42 is a surface of revolution about the axis X, having a circular cross section. Its diameter varies over its height, notably along a curve that decreases and then increases in size symmetrically.

The example in FIG. 16 differs from the one in FIGS. 1 to 5 in that the applicator tip 20 has more than three different, non-symmetrical surfaces, in this case four surfaces 26, 28, 30 and 50. The diameter of the base part 22 is less than the largest dimension of the application part 24.

The applicator tip 20 is then produced by cutting into a cylindrical part with a diameter greater than the largest diameter of the application part having a cylindrical part with a smaller diameter so as to obtain a part that has two parts with different diameters, the first part forming the base part 22 and the second part being intended to form the application part 24. The four different surfaces are then cut into the second part by a cutting tool.

The example illustrated in FIGS. 17 and 18 differs from the one in FIGS. 1 to 5 by way of the shape of the cut surfaces 26, 28, 30 and 32.

When viewed in a direction perpendicular to the median plane M, the surface 26 has a concave shape and the surface 28 has a convex shape. When viewed in a direction in the median plane M, the surfaces 30 and 32 are convex.

As illustrated in FIG. 17, the applicator tip is first of all produced by cutting the surfaces 30 and 32 into a cylindrical part 60, then by cutting the surfaces 26 and 28 into the part obtained.

The example illustrated in FIGS. 19 and 20 differs from the one in FIGS. 1 to 5 by way of the shape of the cut surfaces 26, 28, 30 and 32.

The applicator tip is symmetrical with respect to two median planes M and N.

The surfaces 30 and 32 are planar and symmetrical to one another about the median plane M. Their contours form edges 34 with the base part 22.

The surface 26 is concave and extends on either side of the surfaces 30 and 32.

The surface 28 is convex and constitutes the end of the applicator tip 2. Its contour is formed by curved edges 34 with the surfaces 30 and 32 and by edges 34 with the surface 26.

The applicator tip shown in FIGS. 24 and 25 illustrates the case in which d and $H_2$ can both be small, this giving the application part rigidity and allowing precise application of makeup.

In this example, the tip is a double tip, having two protrusions that form a U between one another when the tip is viewed from the side, as in FIG. 24.

The application part has a conical surface 26, of axis X, that is attached to the base part by an edge 34.

A second surface 28 is defined by the inner face of each protrusion, and a third surface 30 by the bottom of the groove between the two protrusions, this bottom being attached to the inner face 28 of each protrusion by an edge 34, the surfaces 26, 28 and 30 being different in pairs.

The expression "having a" should be understood as being synonymous with having at least one.

The invention claimed is:

1. An applicator for applying a cosmetic product to human keratin materials, comprising:

a holder; and an applicator tip, having a longitudinal axis, that is carried by the holder, the applicator tip including:

a base part, having an axis, for fastening to the holder by way of at least one of its portions, and an application part that is attached to the base part and has at least three surfaces, each surface having a contour formed by:

at least one edge, and/or a base line that acts as a junction between the application part and a cylindrical portion, having an axis, of the base part, wherein shapes of the contours of the at least three surfaces are all different from each other and are all not symmetrical from each other about any axis and any median plane, wherein the applicator tip does not have an axis of symmetry.

2. The applicator according to claim 1, wherein the applicator tip is made of a porous material.

3. The applicator according to claim 1, wherein the applicator tip is impregnated with the cosmetic product.

4. The applicator according to claim 1, wherein the cylindrical portion of the base part is in the form of a cylinder of revolution or is cylindrical with a non-circular base.

5. The applicator according to claim 1, wherein the surfaces of the application part are non-planar and non-perpendicular with respect to the longitudinal axis.

6. The applicator according to claim 1, wherein at least one of the surfaces is obtained by cutting a one-piece cylindrical part.

7. The applicator according to claim 1, wherein the surfaces are not in the form of cylinders of revolution.

8. The applicator according to claim 1, wherein at least two of the surfaces have a common edge.

9. The applicator according to claim 1, wherein the application part has a height $H_2$ less than or equal to 50% of the overall height $H_1$ of the applicator tip.

10. The applicator according to claim 1, wherein the ratio $d/H_2$, of the greatest dimension d in cross section of the applicator tip and the height $H_2$ of the applicator part, is between 0.04 and 14.

11. A packaging and application device, comprising:

a reservoir containing a cosmetic product, and the applicator according to claim 1.

12. The device according to claim 11, wherein the holder of the applicator forms the reservoir containing the cosmetic product.

13. A method for making up an eyelid, having a step of applying eyeliner with the packaging and application device according to claim 11.

14. A method for making up an eyelid, having a step of applying eyeliner with an aid of the applicator as defined in claim 1.

* * * * *